US006473000B1

(12) United States Patent
Secreet et al.

(10) Patent No.: US 6,473,000 B1
(45) Date of Patent: Oct. 29, 2002

(54) METHOD AND APPARATUS FOR MEASURING AND RECORDING VEHICLE SPEED AND FOR STORING RELATED DATA

(76) Inventors: James Secreet, 20 Castle St., McDonald, PA (US) 15057; David Richard Capo, 621 Parliament Dr., Coraopolis, PA (US) 15108; Herbert H. Ohliger, III, 950 Lindsay Rd., Carnegie, PA (US) 15106

( * ) Notice: Subject to any disclaimer, the term of this patent is extended or adjusted under 35 U.S.C. 154(b) by 0 days.

(21) Appl. No.: 09/999,728

(22) Filed: Oct. 24, 2001

(51) Int. Cl.[7] ..... G08G 1/01
(52) U.S. Cl. ..... 340/936; 340/933; 701/93
(58) Field of Search ..... 340/936, 905–933; 701/93

(56) References Cited

U.S. PATENT DOCUMENTS

D355,616 S 2/1995 Gregg, III et al.
5,510,793 A 4/1996 Gregg, III et al.
5,572,450 A 11/1996 Worthy
5,935,190 A 8/1999 Davis et al.
5,948,038 A 9/1999 Daly et al.
5,977,884 A 11/1999 Ross
6,011,515 A * 1/2000 Radcliffe et al. ..... 342/453
6,040,766 A * 3/2000 Lubke et al. ..... 340/438
6,121,898 A 9/2000 Moetteli
6,163,277 A 12/2000 Gehlot
6,163,742 A 12/2000 Shimizu
6,166,658 A * 12/2000 Testa ..... 701/93
6,201,493 B1 3/2001 Silverman
6,208,268 B1 3/2001 Scarzello et al.
6,265,989 B1 * 7/2001 Taylor ..... 340/901

* cited by examiner

*Primary Examiner*—Daryl Pope
(74) *Attorney, Agent, or Firm*—William P. Smith; DKW Law Group, P.C.

(57) ABSTRACT

A computer program product for speed limit enforcement is executable on a portable computer to measure the elapsed time it takes a motor vehicle to traverse a premeasured course along a roadway. The start and stop signals are manually input by a traffic officer via assigned keys on a keyboard, to capture the time interval between the last start signal and the stop signal. A start signal is entered upon a vehicle crossing a first measurement line, and a stop signal is entered upon the vehicle's crossing a second measurement line, the distance between the lines having been preselected from a set of geographic location data. The program converts the time measurement to the relevant units, typically miles per hour, for comparison to a threshold limit stored in a buffer. The time trial is displayed on the computer screen and each record is stored in a cumulative relational database for upload to a back office system for generating historical and statistical reports. The program is useful for enforcement of traffic speed limit laws and collection of evidentiary data.

21 Claims, 6 Drawing Sheets

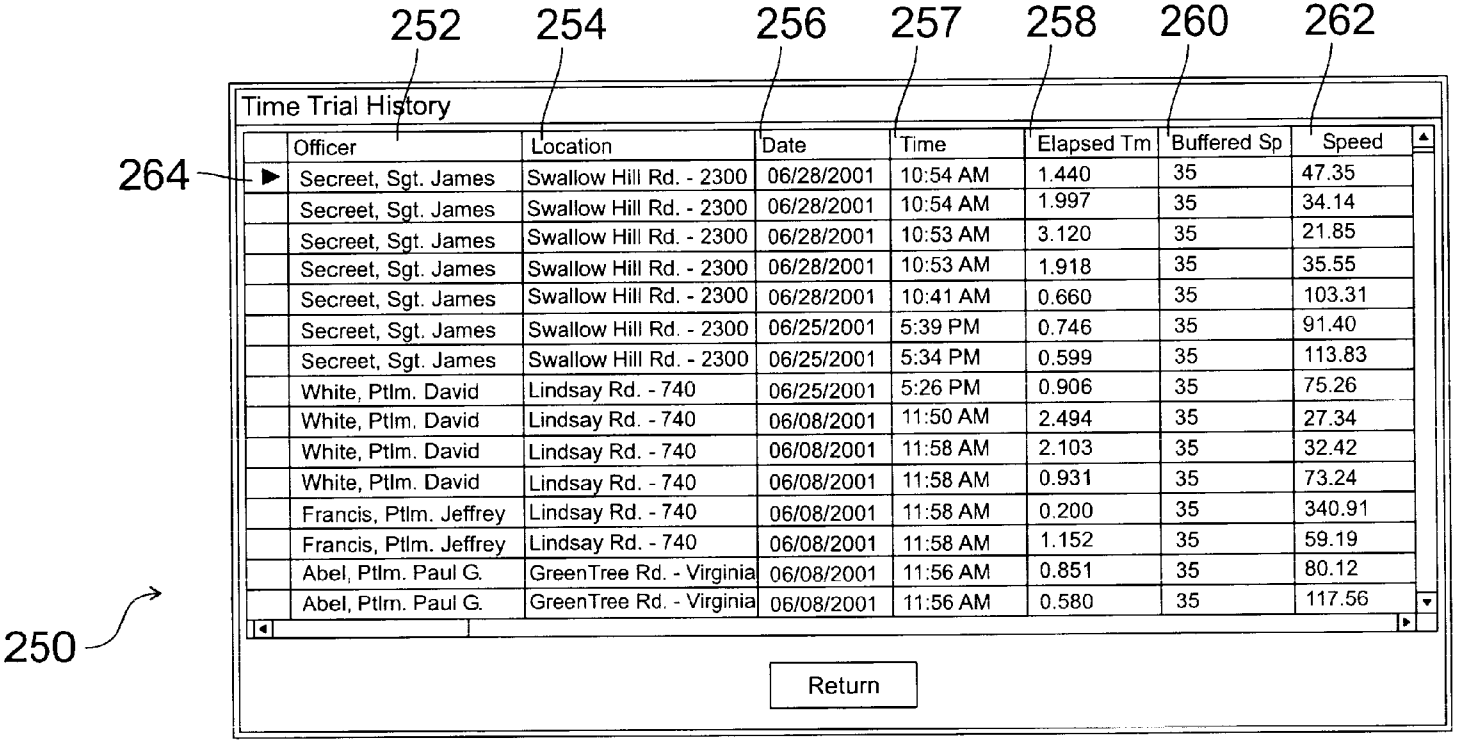

| Officer | Location | Date | Time | Elapsed Tm | Buffered Sp | Speed |
|---|---|---|---|---|---|---|
| Secreet, Sgt. James | Swallow Hill Rd. - 2300 | 06/28/2001 | 10:54 AM | 1.440 | 35 | 47.35 |
| Secreet, Sgt. James | Swallow Hill Rd. - 2300 | 06/28/2001 | 10:54 AM | 1.997 | 35 | 34.14 |
| Secreet, Sgt. James | Swallow Hill Rd. - 2300 | 06/28/2001 | 10:53 AM | 3.120 | 35 | 21.85 |
| Secreet, Sgt. James | Swallow Hill Rd. - 2300 | 06/28/2001 | 10:53 AM | 1.918 | 35 | 35.55 |
| Secreet, Sgt. James | Swallow Hill Rd. - 2300 | 06/28/2001 | 10:41 AM | 0.660 | 35 | 103.31 |
| Secreet, Sgt. James | Swallow Hill Rd. - 2300 | 06/25/2001 | 5:39 PM | 0.746 | 35 | 91.40 |
| Secreet, Sgt. James | Swallow Hill Rd. - 2300 | 06/25/2001 | 5:34 PM | 0.599 | 35 | 113.83 |
| White, Ptlm. David | Lindsay Rd. - 740 | 06/25/2001 | 5:26 PM | 0.906 | 35 | 75.26 |
| White, Ptlm. David | Lindsay Rd. - 740 | 06/08/2001 | 11:50 AM | 2.494 | 35 | 27.34 |
| White, Ptlm. David | Lindsay Rd. - 740 | 06/08/2001 | 11:58 AM | 2.103 | 35 | 32.42 |
| White, Ptlm. David | Lindsay Rd. - 740 | 06/08/2001 | 11:58 AM | 0.931 | 35 | 73.24 |
| Francis, Ptlm. Jeffrey | Lindsay Rd. - 740 | 06/08/2001 | 11:58 AM | 0.200 | 35 | 340.91 |
| Francis, Ptlm. Jeffrey | Lindsay Rd. - 740 | 06/08/2001 | 11:58 AM | 1.152 | 35 | 59.19 |
| Abel, Ptlm. Paul G. | GreenTree Rd. - Virginia | 06/08/2001 | 11:56 AM | 0.851 | 35 | 80.12 |
| Abel, Ptlm. Paul G. | GreenTree Rd. - Virginia | 06/08/2001 | 11:56 AM | 0.580 | 35 | 117.56 |

Fig. 3

METHOD AND APPARATUS FOR MEASURING AND RECORDING VEHICLE SPEED AND FOR STORING RELATED DATA

RELATED APPLICATIONS

There are no applications related to this invention anywhere in the world.

BACKGROUND OF THE INVENTION

Timing devices exist which are used by law enforcement to measure the rate of speed of a vehicle on a roadway to enforce legal speed limits applicable to traffic. One method employs a pre-measured, marked-off course with a police officer operating a stopwatch or similar timing device to measure the lapsed time between the two pre-measured points when traveled by a vehicle through the course. Once the time is captured, the officer, by converting the timing to miles per hour (mph), determines whether the vehicle has exceeded the speed limit and then responds appropriately by issuing a traffic citation, making an arrest or other appropriate action.

Usually, a reference chart will be prepared if there is no equipment to automatically generate and convert an mph display. Since mph is the parameter set forth in most United States jurisdictions, conversion is necessary since a one-mile course is not a readily observable distance from a single observation point by an individual officer.

One way of accomplishing this conversion is to prepare a chart based on the course pre-measured distance to indicate the number of seconds it takes to travel the measured distance at the legal speed limit. When a vehicle is timed in less than the calculated interval, it has exceeded the allowable speed limit. A chart may be developed whereby a graduated chart indicates the speed which corresponds to one-second intervals up to the minimum number of seconds corresponding to the maximum speed allowed by law. This provides the law enforcement officer with a reference table with which to ascertain the degree of the speed limit violation.

Another method of speed measurement includes electromechanical devices which operate from a pair of pneumatic hoses laid across a traffic lane at pre-measured intervals. The weight of the vehicle passing over the first pneumatic hose generates an instantaneous impulse and a second impulse occurs when passing over the second pneumatic hose. The intervals measured between first and second impulses generate a vehicle speed in miles per hour.

Still yet another method incorporates a radar "beam" which operates by measuring sound waves reflected from a moving vehicle, then displaying the vehicle speed almost instantly. These methods require the officer to carry a separate piece of equipment.

Existing vehicle speed measurement methods must be reliable in order to provide evidentiary support for court proceedings. The better the evidence, the greater the likelihood of a conviction.

Stopwatch methods and electromechanical radar devices are not normally specially equipped for storing data in a retrievable format. Thus, operator, location, date, calibration and various other relevant data must be tabulated and recorded separately for entry later into a central database.

However, many law enforcement organizations have begun to equip their control units with portable computers, or "laptop PCs", as they are commonly referred to. Laptop PCs enable police officers to have access to specialized databases for law enforcement only to obtain such information as the driver's license number, automobile registration number and traffic and other outstanding law enforcement citations. Due to the versatility and capacity of laptop PCs, it would be advantageous to utilize the laptop PCs for collecting and associating traffic speed limit and speed enforcement data. The development of the present invention solves these problems as noted below.

SUMMARY OF THE INVENTION

In a computer system having a processor and a memory, the memory connected to the processor and storing computer executable instructions, what is disclosed is a computer-implemented method of measuring and recording vehicle velocity over a pre-measured distance. The method includes the steps of manually inputting a start signal corresponding to a vehicle when the vehicle crosses a line on a pre-measured section of road; measuring the computer system elapsed time commencing at the instant the start button is pushed; upon the vehicle crossing a second line, indicating the end of the pre-measured section of road, manually inputting a stop signal; capturing the elapsed time corresponding to the inputting of the stop signal; calculating the velocity of the vehicle by dividing the premeasured distance by the elapsed time; converting the vehicle velocity to miles per hour; displaying the vehicle velocity information on a computer screen; comparing the vehicle velocity to the buffered speed, which may be the legal speed limit or a value in excess of the legal speed limit; determining if the vehicle velocity exceeds the buffered speed value; and signaling to an operator if the vehicle exceeds the predetermined velocity value.

The method disclosed in the present invention may also comprise the steps of confirming the selection of a location identifier, with associated data indicating the pre-measured distance of the course and applicable legal speed limit at that location. The method also includes confirming the selection of an operator identifier and providing local disk storage means for storing information in a database format. The stored information includes at least operator identifier, location identifier, vehicle velocity, predetermined velocity value and time data.

A computer readable medium having computer executable instructions therein is also disclosed, which, when executed by a computer, perform a method of measuring and recording vehicle velocity.

It is an object of the present invention to provide a Microsoft Windows®-based speed timing and tracking system, for use in a portable computer device, that calculates the velocity of a moving vehicle in miles per hour.

It is another object of the present invention to provide an indication to a law enforcement officer visually and audibly when a vehicle is exceeding the speed limit.

Yet another object of the present invention is to capture vehicle speed time trial statistics for reporting and citation purposes.

A further object of the present invention is to accumulate data related to time trials in a widely used format such as Microsoft Access® database format.

Another object of the present invention is to provide pre-formatted historical reports as well as user-customized report capability in a back-office system.

BRIEF DESCRIPTION OF THE DRAWINGS

FIG. 3 is a display screen of the time trial history table;

DETAILED DESCRIPTION OF THE INVENTION

Figure 1:
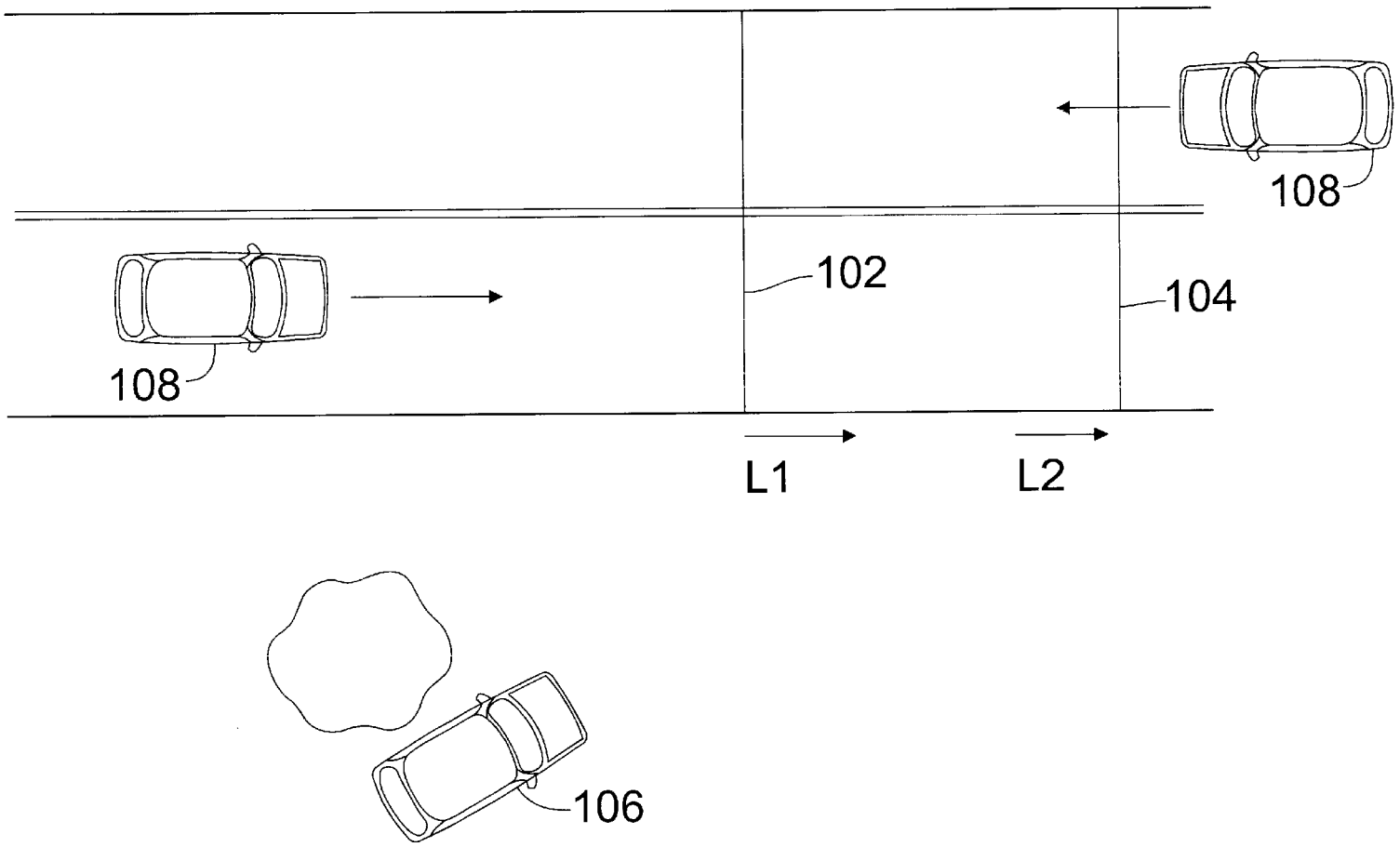
FIG. 1 is a schematic diagram of a time trial course with a law enforcement officer stationed to one side of a pre-measured course along a roadway.

In a preferred embodiment as depicted in FIG. 1, two fixed points are designated as L1, L2. These represent painted lines 102, 104 on the roadway. A patrol vehicle 106 is stationed strategically adjacent to the roadway such that an officer sitting in the driver or passenger seat of the vehicle can readily observe both lines 102 and 104. A first vehicle 108 traveling left to right in the illustration approaches the marked-off course and passes over the first line 102. At that point, the officer strikes the start key to begin the timing sequence. The start key instantaneously sets the time equal to zero and begins calculating the time. The vehicle 108 continues in the same direction until it passes the second line 104 at which point the officer strikes the stop key which instantly stops the timing interval and provides a measurement of time that elapsed since the start key was pushed.

The time value is then inserted into an algorithm which, given the predetermined distance d and the elapsed time t between crossing the lines 102 and 104, generates a speed calculated in miles per hour.

The conversion algorithm operates as follows:

(d/t ft./sec.)(3600 seconds/1 hour)(1 mile/5280 feet), where d=distance in feet of the pre-measured course.

A typical course will be one hundred (100) feet or 0.0189 miles.

When the time trial is complete (after the stop button captures the elapsed time), the time t, in seconds, is converted to hours by dividing by 3600. For example, a time of 1.54 seconds=0.0004194 hour, which on a 100 foot course equates to 45 miles per hour (0.0189 mi/0.0004194 hour).

White, yellow or other high-visibility paint is used to mark the lines at either end of the course. One hundred feet to one hundred fifty feet course length is preferred because an officer may readily observe two marked lines one hundred to one hundred fifty feet apart on a roadway from a vantage point close to the road. Depending on the specific location, a longer or shorter course may be preferred, provided the view of the user is unobstructed between the two lines demarcating the course.

Referring again to FIG. 1, a second vehicle 110 is shown approaching from the opposite direction as the first vehicle 108. In this example, it would be assumed that first vehicle 108 has crossed line 102 and is traveling between lines 102 and 104 when the second vehicle 110 approaches line 104. At that point, the first patrol car 106 may elect to restart the sequence to time the second vehicle 110 as it crosses line 104 and measure the second vehicle's lapsed time between lines 104 and 102. Thus, the first measured cycle is abandoned and a new cycle is started without having to restart the entire sequence. In other words, once a timing sequence has begun, it may be restarted at any time, say for example, when another approaching vehicle appears to be traveling at a greater speed than the one which is currently being timed. Therefore, the officer has the option to abandon the first time sequence and pursue a more likely violator.

The timer function employed in the preferred embodiment is a Microsoft® utility program timeGetTime™. The timeGetTime™ function retrieves the system time in milliseconds. The system time is the time elapsed since Windows® was started.

The system is a Microsoft Windows®-based speed timing and tracking device to facilitate the following:

- calculate the velocity of a moving vehicle along a roadway;
- indicate to an officer visually and audibly when a vehicle is exceeding the speed limit;
- capture speed time trial data for statistical reporting and citation purposes; and
- store the captured data in a common format such as, for example, the popular Microsoft® Access database. (Many other commercially available database formats can be employed, and the example given is not intended to limit the database applications that may be interfaced with the program disclosed herein.) Certain historical reports are provided with the package. Customized reports may also be designed by the end user.

Figure 2:
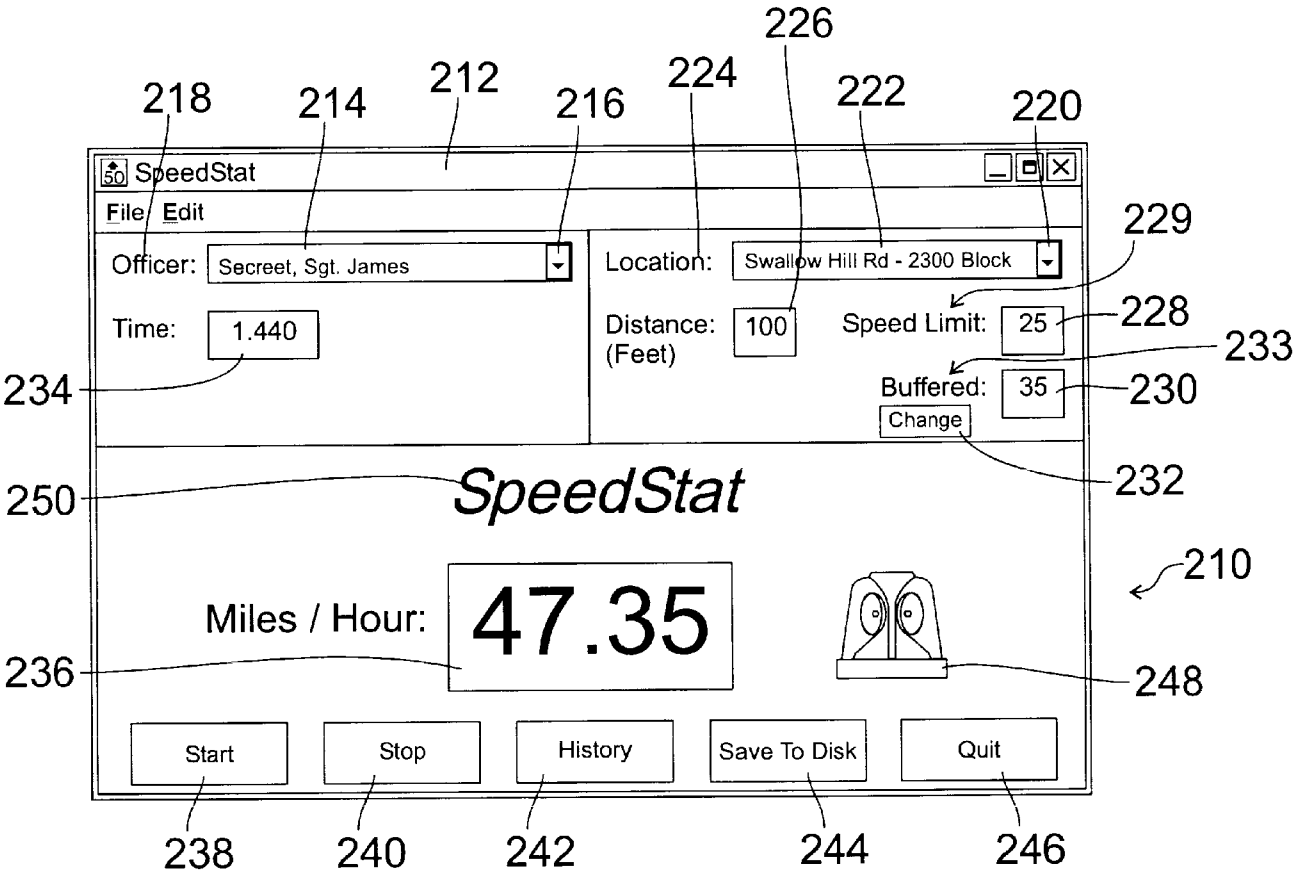
FIG. 2 is an example of a time trial display screen.

Referring next to FIG. 2, there is an illustration of the screen display in the Windows®-based application of the present invention. The screen display is generally designated 210. As is typical of all Windows® applications, there is a menu bar 212 associated with the application that contains certain operating system commands common to all Windows®-based applications, for example, minimize, maximize, exit, edit and file options.

The details of the screen display 210 contents are as follows.

The officer may be selected from a predefined list containing the names of all the police officers that may be required to operate the program. Selection is made by mouse-clicking selection box 216 to display the table of officer codes. Each officer must be identified by name, or by a unique identifier such as a badge number. The name of the officer selected appears in an active window 214. The title of a field display 218 is indicated to the left of the active window 214. It is necessary for accurate record keeping to identify the operator of the program at the time a record is entered into the database, as will be discussed in further detail below.

Similarly, the location may be selected via a selection box 220 associated with a window 222. The location is also selected from a predefined table of location codes. The selection of a location determines the distance, posted speed limit and buffered speed limit to be associated from that location. All of these values have been entered previously in association with each location.

A title 224 of window 222 is displayed to the left of window 222.

The buffered speed limit is displayed in a window 230. The buffered speed limit is defined as the threshold value to which the speed of the vehicle is compared to determine whether the vehicle is exceeding the permissible limit. The buffered speed limit can be adjusted at the officer's discretion using a change button 232 to open another window for entering a new speed limit. For example, the posted speed limit—displayed in a window 228—for a location might be 35 miles per hour. Usually, the local governing body tolerates speeds marginally above the posted limit. Therefore, the buffered speed may be 10 miles per hour greater, or 45 miles an hour. Under other circumstances, the buffered speed limit might be less than the posted speed limit such as within a school zone. The titles of the buffered and actual speed limits 233, 229 are shown to the left of the associated windows.

A distance window 226 indicates the length in feet of the pre-measured course associated with the selected location.

The normal distances are one hundred (100) feet and one hundred fifty (150) feet.

The elapsed time since the last start request is displayed in a window 234. The time is displayed as seconds, with three decimal positions to an accuracy in a thousandth of a second from when a start button 238 was depressed.

The rate of speed of a vehicle is displayed in a window 236 as miles per hour (mph). The value is calculated as a function of distance and time after the timer cycle is completed. The cycle is completed when a operator presses a stop button 240.

Start button 238 when pressed resets and initiates the time counter. The start button 238 shown on the display is an optional virtual selector button. This button is actually "pressed" by a mouse click. As indicated above, another key (not shown) on the keyboard may be assigned to be a start button as well, and the start signal is initiated by pressing the assigned key. It is the option of the operator whether to use the click-on start button 238 or an assigned key on the keyboard.

If the start button 238 is pressed again before the stop button 240, the time counter is again reset and instantaneously initiated. This permits the operator to quickly start the timing of another vehicle before completing a time cycle for the prior vehicle.

Stop button 240 stops the time counter and then performs the miles per hour calculation. This button 240 is also a virtual button, and a keyboard key is also assigned as stop button. Virtual stop button 240 is triggered by the click of a mouse. The consecutive pressing of the start 238 and stop 240 buttons constitutes a time trial. Upon completion of a time trial, the information is recorded in a history file.

A history display button 242 when pressed (or clicked) displays a new screen (shown in FIG. 3) with the history of the recorded time trials by descending time and date. This information can then be combined with other officers' histories and appended to a master history database residing in the back-office version of the package. The back-office program provides features that are used for reporting and statistical analysis.

Clicking the save to a disk button 244 displays a common dialog window for saving the current historical data to a diskette. The officer can then deliver the diskette to the main office for combining his data with other officers on the force for reporting and statistical analysis.

Clicking on Quit button 246 ends the application.

Referring next to FIG. 3, a table 250 contains the time trial history stored in a file on the laptop PC in which the program is running. Column titles designate the information contained therein. Column one 252 contains officer information. Column two 254 contains location information. Column three 256 contains the date the record was entered. Columns 257, 258, 260 and 262 contain the time, the elapsed time, the buffered speed and the measured speed, respectively. Additional columns may be included in the table, and may be customized by the user by adding columns for particular data that may be useful. Individual records are represented by horizontal rows 264, and may be retrieved and manipulated according to a back-office version of the program to generate customized reports.

Figure 4:
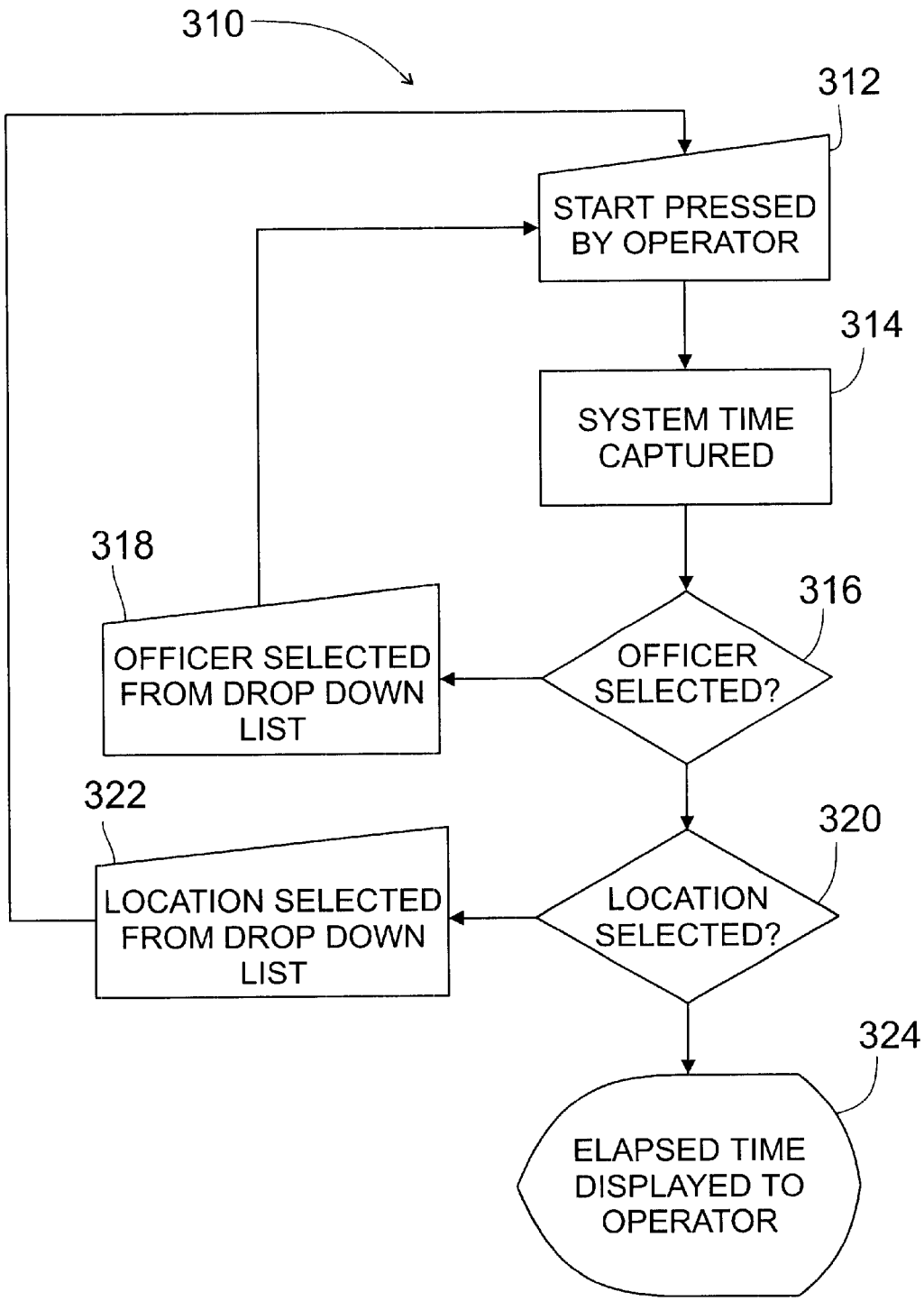
FIG. 4 is a program flow chart illustrating the start button processing sequence.
Figure 5:
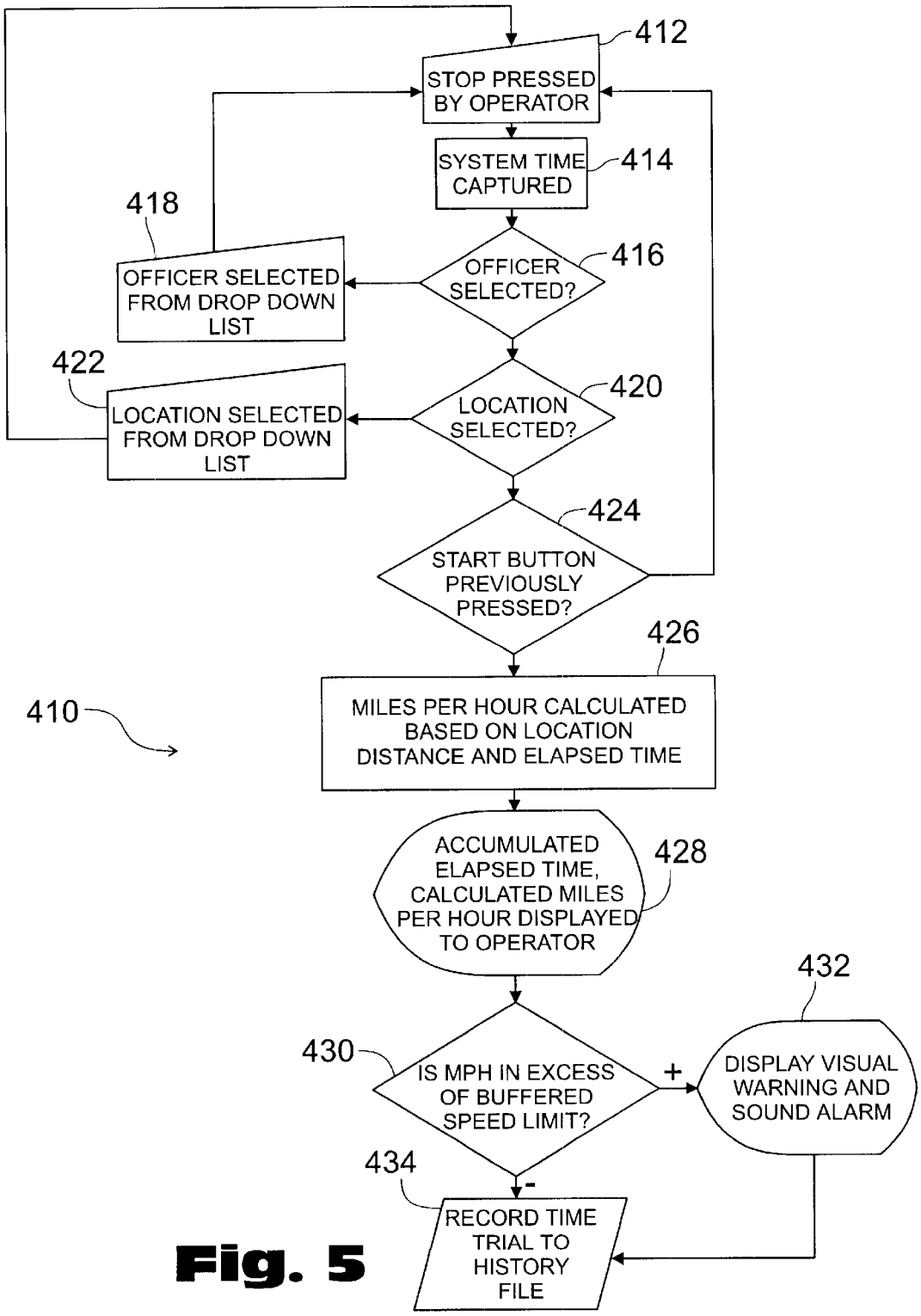
FIG. 5 is a program flow chart illustrating the stop button processing sequence.

Referring next to FIGS. 4 and 5, a flow chart 310 shows the sequence in which the start button is processed. A manual input 312 signifies that the start button has been pressed. The system time is instantaneously captured 314 using the timeGetTime™ utility described above, or any other similar program. In a next step 316, the system decides whether the officer field is populated (i.e., has an officer been selected?). If not, the system prompts the user to select an officer from a drop-down list 318 before pressing the manual start button 312. If an officer has already been selected, the program then decides whether the location field is also populated 320. If not, the system prompts the user to select a location from a drop-down list 322 before pressing the start button 312. If the location and officer fields are both populated, the graphic user interface 210 displays the elapsed time 324 to the second decimal point or to the hundredths of a second. The display 210 then continues counting elapsed time until a manual stop button 412 is pressed.

Referring next to FIG. 5, stop button processing is described by a flow chart 410. The manual stop input 412 signals when the stop button is pressed. In a next step 414, the system time is captured. The program decides whether an officer 416 and location 420 have been selected, and if not, prompts the user for the appropriate manual selection—officer 418 or location 422. It should be noted that this step is necessary because the start button processing 310 and stop button processing are completely independent of each other.

After these two conditions 416, 420 have been satisfied, the program then decides whether the start button has been pressed 424. If not, the system returns for the next manual stop input signal 412. If the system start button has been pressed, the system performs the calculation to convert the feet per second to miles per hour 426, based on the elapsed time and the distance in feet associated with the location.

The accumulated elapsed time is then displayed to the operator 428. The speed calculation is then compared with the buffered speed limit 430. If the vehicle speed exceeds the value of the buffered speed, the program displays a visual warning and sounds an audible alarm 432. In any event, the time trial is recorded to a history file 434.

As is readily apparent, there is nothing to prevent the operator from initiating two consecutive start signals 312. The last start button signal marks the measuring point for the elapsed time 324. This enables an officer to abort a time cycle in the middle of the cycle, and begin a new one. This capability is an advantage when an officer is routinely clocking every car, and an obviously speeding vehicle suddenly approaches. The routine timing cycle can be interrupted instantaneously, and the system restarted to time the apparent violation.

The satisfaction of the officer selections 316, 416 and location selections 320, 420 is important for successful operation of the program. The location selection 320, 420 has associated with it a predetermined distance. Without the value for the distance, the time cannot be converted to miles per hour. The time can be calculated without the name of the officer being associated. The officer's name is critical for the record keeping function to validate the record, for example, in the case of verifying evidence. The business record would identify the eyewitness—that is, the officer—who actually entered the data. Since this is automated, there is substantial authentication of the record placed into evidence.

Figure 6:
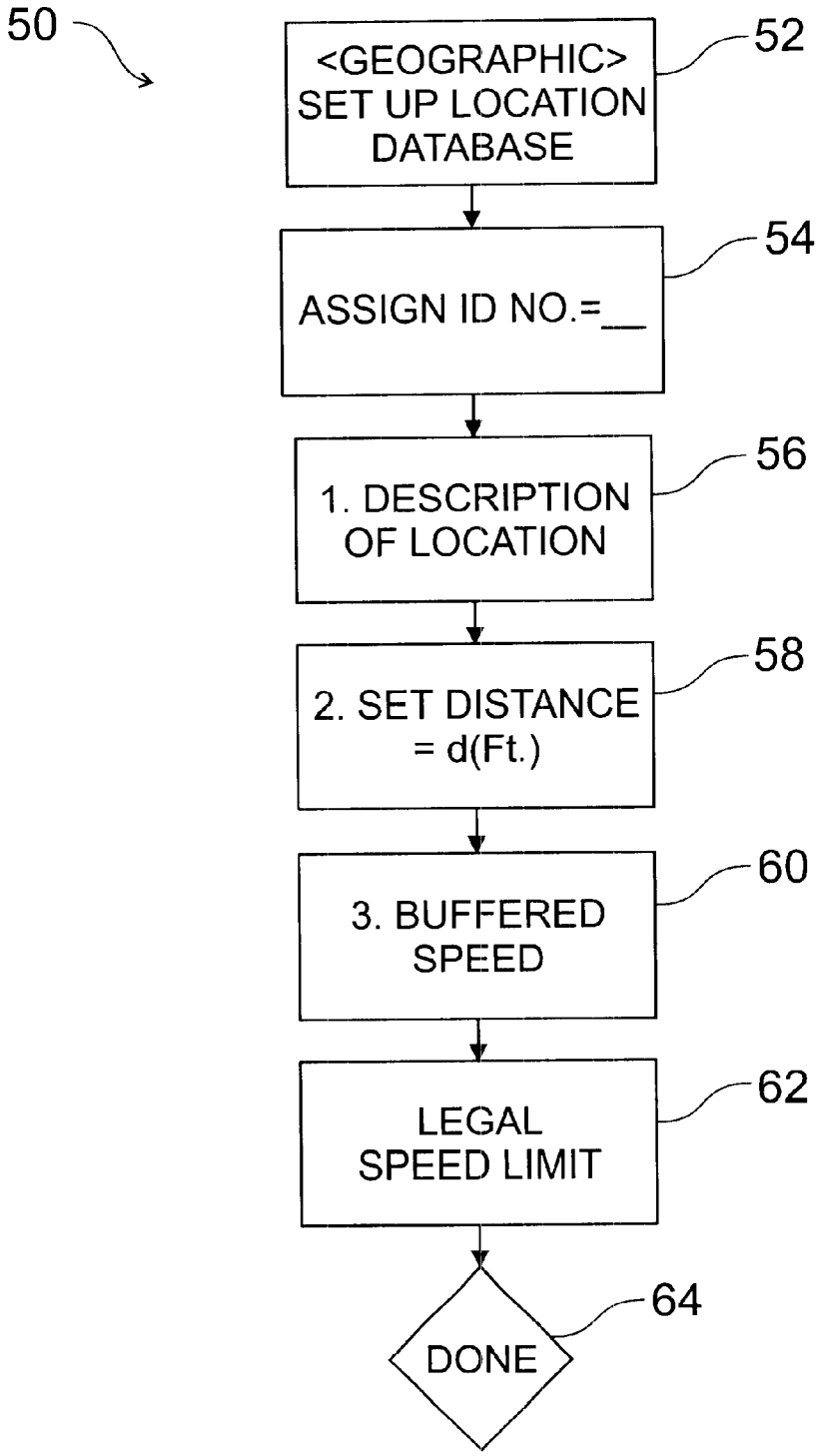
FIG. 6 is a flow chart illustrating the location data stored parameters.

Referring next to FIG. 6, an associated program comprises the logic steps shown in a flowchart in order to provide identification of the geographical location. The first step of generating the location ID table is generally designated as step 50. At step 52, a location database is defined comprising a plurality of field designations. The next step 54 is to assign an identification number associated with each individual geographic location. The next step 56 is to provide a description of the location indicating, for example, the street name and intersection and if applicable, the direction of travel of the lanes which are being monitored.

In the next step 58, a set distance for the pre-measured course is associated with the specific location so as to automatically provide the distance value of the pre-measured course, which is associated with a given location ID. The next step 60 is to enter a buffered speed limit, which may or may not be equal to the legal speed limit associated with the location. After entering the buffered speed, at step 62, the legal speed limit is entered. Finally, step 64 is to provide the operator the option of DONE. If the response is NO, the program returns to the initial step 52 to set up another geographic location identifier. Thus, the steps set forth in flowchart 50 in FIG. 6 provide a preset value which can be associated with a location ID in a program sequence 10 at step 14 which when inserted will automatically provide location and distance information for steps further down the sequence. Because the distances are pre-entered, an officer cannot mistakenly enter a wrong distance for a location.

The above is a description of the process used to measure and record the vehicular rate of speed. Initially, the officer has the option of setting up or changing some of the parameters of the program. These include the option for customization of certain program features. The operator can choose from a selection of button combinations on the keyboard. As stated above, some keyboard keys are reserved by the Windows® operating system for certain functions and cannot be used for the application. The buttons will be the timing buttons for the timing of the target vehicle.

A location ID is provided including at least the date, a distance of the pre-measured course and the legal speed limit associated with that location. The officer's personal identification information must also be provided before the program will operate.

The preferred embodiment of the invention also includes a built-in warning notice to the operator. The program warns the operator if a vehicle is clocked above that speed. The warning sounds like a police siren in the preferred embodiment, and the visible warning appears as a revolving flasher similar to those commonly used on police vehicles. This feature allows an officer to keep his eyes on the reference points. After a clock is done, if no warning sounds, the officer can continue clocking other vehicles, making their clocks more accurate. If the alarm does sound, then the officer can immediately pursue a violator without taking his eyes off the road or the violator.

Information from the data acquired from the entire sequence is saved as a new table entry and stored in the history table. Preferably, all operator time trials are saved into a history file; time trials are recorded with time of day, speed and location. The officer can print clocks with times, distance and operator information. These printouts can be given to the violator or attached to the citation for court proceedings.

When the operator exits out of the program, all data is automatically saved. At the end of an officer's shift, this history is copied to a diskette and put into a back-office database program by the department's administrator. After a period of time of entering all officers' diskettes into the base program, a variety of statistics can be obtained. Information saved in the file history may include the following:

i. the number of clocks at a particular location;

ii. the time of day the clocks are being made;

iii. the speeds at which officers are issuing citations;

iv. the time of day the fastest speeds are being recorded;

v. how many vehicles a particular officer is clocking;

vi. what the average speed is at a particular location; and vii. what times an officer is doing the clocking.

Information can also be obtained for a particular officer, shift, day, week, month or year. The gathered information can assist administrators in the evaluation on how to effectively enforce traffic regulations.

Although the invention has been described above by reference to an embodiment of the invention, the invention is not limited to the embodiment described above. Modifications and variations of the embodiment described above will occur to those skilled in the art, in light of the above teachings without departing from the spirit of the invention. It is the invention, therefore, to be limited only as indicated by the scope of the claims appended hereto.

We claim:

1. In a computer system having a processor and a memory, the memory connected to the processor and storing computer executable instructions, a method of measuring and recording vehicle velocity over a premeasured distance, wherein the method comprises the steps of:

a) manually inputting a start signal corresponding to a vehicle entering the premeasured distance;

b) measuring elapsed time commencing instantaneously upon said inputting of the start signal;

c) manually inputting a stop signal corresponding to a vehicle exiting the premeasured distance;

d) capturing the elapsed time corresponding to the inputting of said stop signal;

e) calculating the velocity of the vehicle;

f) converting the vehicle velocity to miles per hour;

g) displaying the vehicle velocity information on a computer screen;

g) comparing the vehicle velocity to a predetermined velocity value;

h) determining if the vehicle velocity exceeds said predetermined velocity value; and i) signaling to an operator if the vehicle exceeds the predetermined velocity value.

2. The method as set forth in claim 1, also comprising the steps of confirming the selection of a location identifier wherein said location identifier includes the distance information necessary for computing a velocity.

3. The method as set forth in claim 2, also comprising confirming the selection of an operator identifier.

4. The method as set forth in claim 3, also comprising providing local disk storage means for storing information in a database format, said information including at least an operator ID, location ID, vehicle velocity, predetermined velocity value, and time data.

5. The method as set forth in claim 1, wherein manual input of the start signal is accomplished by depressing a first assigned key on a computer keyboard.

6. The method as set forth in claim 5, wherein manual input of the stop signal is accomplished by depressing a second assigned key.

7. The method as set forth in claim 1, wherein signaling to the operator includes generating an audibly perceptible signal.

8. The method as set forth in claim 1, wherein signaling to the operator includes generating a visibly perceptible signal.

9. The method as set forth in claim 1, wherein signaling to the operator includes generating both an audibly perceptible signal and a visibly perceptible signal.

10. The method as set forth in claim 4, wherein said predetermined velocity value is equal to or greater than a posted legal speed limit associated with said location identifier.

11. The method as set forth in claim 4, wherein also associating the stored information in a cumulative relational database capable of being manipulated to yield analytical and statistical reports.

12. A computer readable medium having computer executable instructions therein, which, when executed by a computer, performs a method of measuring and recording vehicle velocity over a premeasured distance, wherein the method comprises the steps of:

a) manually inputting a start signal corresponding to a vehicle entering the premeasured distance;

b) measuring elapsed time commencing instantaneously upon said inputting of the start signal;

c) manually inputting a stop signal corresponding to a vehicle exiting the premeasured distance;

d) capturing the elapsed time corresponding to the inputting of said stop signal;

e) calculating the velocity of the vehicle;

f) converting the vehicle velocity to miles per hour;

g) displaying the vehicle velocity information on a computer screen;

h) comparing the vehicle velocity to a predetermined velocity value;

i) determining if the vehicle velocity exceeds said predetermined velocity value; and j) signaling to an operator if the vehicle exceeds the predetermined velocity value.

13. The computer readable medium as set forth in claim 12, the method also comprising the steps of confirming the selection of a location identifier wherein said location identifier includes the distance information necessary for computing a velocity.

14. The computer readable medium as set forth in claim 13, the method also comprising confirming the selection of an operator identifier.

15. The computer readable medium as set forth in claim 14, the method also comprising providing local disk storage means for storing information in a database format, said information including at least an operator ID, location ID, vehicle velocity, predetermined velocity value, and time data.

16. The computer readable medium as set forth in claim 12, wherein the method of manual input of the start signal is accomplished by depressing a first assigned key on a computer keyboard.

17. The computer readable medium as set forth in claim 16, wherein the method of manual input of the stop signal is accomplished by depressing a second assigned key.

18. The computer readable medium as set forth in claim 12, wherein the method of signaling to the operator includes generating an audibly perceptible signal.

19. The computer readable medium as set forth in claim 12, wherein the method of signaling to the operator includes generating a visibly perceptible signal.

20. The computer readable medium as set forth in claim 12, wherein the method of signaling to the operator includes generating both an audibly perceptible signal and a visibly perceptible signal.

21. The computer readable medium as set forth in claim 16, wherein said predetermined velocity value is equal to or greater than a posted legal speed limit associated with said location identifier.

* * * * *